US005743029A

United States Patent [19]

Walker et al.

[11] Patent Number: 5,743,029

[45] Date of Patent: Apr. 28, 1998

[54] BREAK-AWAY CLEAT ASSEMBLY FOR ATHLETIC SHOES

[76] Inventors: Andrew S. Walker, 815 Southfield Rd., Birmingham, Mich. 48009; Elwyn Gooding, 2989 W. N. Territorial Rd., Ann Arbor, Mich. 48105

[21] Appl. No.: 713,954

[22] Filed: Sep. 13, 1996

Related U.S. Application Data

[63] Continuation of Ser. No. 416,219, Apr. 4, 1995, Pat. No. 5,617,653, which is a continuation of Ser. No. 967,618, Oct. 28, 1992, abandoned, which is a continuation-in-part of Ser. No. 689,702, Apr. 15, 1991, abandoned.

[51] Int. Cl.[6] ..... A43C 15/16; A43C 15/00

[52] U.S. Cl. ..... 36/134; 36/59 R; 36/114

[58] Field of Search ..... 36/114, 101, 134, 36/61, 62, 15, 67 R, 59 R, 67 D, 126, 127, 128, 129, 130

[56] References Cited

U.S. PATENT DOCUMENTS

| | | | |
|---|---|---|---|
| 1,278,320 | 9/1918 | Ellithorpe | 36/59 A |
| 1,760,084 | 5/1930 | Pierce | 36/67 D |
| 2,183,277 | 12/1939 | Heilhecker | 36/15 |
| 2,495,984 | 1/1950 | Roy | 36/15 |
| 2,745,197 | 5/1956 | Holt . | |
| 3,020,654 | 2/1962 | McCann . | |
| 3,054,197 | 9/1962 | Morgan et al. . | |
| 3,354,561 | 11/1967 | Cameron . | |
| 3,481,332 | 12/1969 | Arnold . | |
| 3,526,976 | 9/1970 | Jacobs . | |
| 3,538,628 | 11/1970 | Einstein, Jr. | 36/15 |
| 3,566,488 | 3/1971 | Pilarski | 36/135 |
| 3,583,082 | 6/1971 | Jordan, Jr. . | |
| 3,619,916 | 11/1971 | Neri . | |
| 3,668,792 | 6/1972 | York | 36/59 R |
| 3,672,077 | 6/1972 | Coles | 36/130 |
| 3,707,047 | 12/1972 | Nedwick | 36/59 R |
| 3,744,160 | 7/1973 | Dymond | 36/59 R |
| 3,769,723 | 11/1973 | Masterson et al. | 36/51 X |
| 3,782,011 | 1/1974 | Fisher | 36/59 R |
| 3,816,945 | 6/1974 | Egtvedt | 36/32 R X |
| 3,834,723 | 9/1974 | Erlebach . | |
| 3,982,336 | 9/1976 | Herro | 36/62 |
| 4,010,559 | 3/1977 | Mitchell | 36/128 |
| 4,114,295 | 9/1978 | Schaefer | 36/100 |
| 4,226,032 | 10/1980 | Herro | 36/127 |
| 4,262,434 | 4/1981 | Michelotti | 36/67 D |
| 4,279,083 | 7/1981 | Dilg | 36/101 |
| 4,317,294 | 3/1982 | Goodyear | 36/100 |
| 4,377,042 | 3/1983 | Bauer | 36/101 |
| 4,414,763 | 11/1983 | Bente | 36/134 |
| 4,420,894 | 12/1983 | Glassman | 36/12 |
| 4,439,935 | 4/1984 | Kelly | 36/101 |
| 4,492,047 | 1/1985 | Arff | 36/134 |
| 4,531,733 | 7/1985 | Hall | 273/25 |

(List continued on next page.)

FOREIGN PATENT DOCUMENTS

| | | |
|---|---|---|
| 90884 | 10/1983 | European Pat. Off. . |
| 153136 | 8/1985 | European Pat. Off. . |

OTHER PUBLICATIONS

Torg et al., M.D., "The Shoe–Surface Interface and its Relationship to Football Knee Injuries," Journal of Sports Medicine, vol. 2, No. 5, pp. 261–269, Sep./Oct. 1974.

Bonstingl et al., "Torques Developed by Different Types of Shoes on Various Playing Surfaces," Medicine and Science in Sports, vol. 7, No. 2, pp. 127–131, 1975.

Cameron et al., M.D., "The Swivel Football Shoe: A controlled Study," The Journal of Sports Medicine, pp. 16–27, Jan./Feb. 1973.

*Primary Examiner*—B. Dayoan

*Attorney, Agent, or Firm*—Brooks & Kushman P.C.

[57] ABSTRACT

A cleat assembly for athletic shoes to reduce injuries to athletes. The cleat assembly includes a base assembly and a cleat which is releasably coupled to the base assembly in response to a predetermined force extending substantially lateral to the longitudinal axis of the cleat for reducing injuries. The cleat can be either a rotational cleat or a stationary cleat. The base assembly can be integrally formed with the sole of the athletic shoe or formed as a separate element.

1 Claim, 9 Drawing Sheets

U.S. PATENT DOCUMENTS

| | | | |
|---|---|---|---|
| 4,633,600 | 1/1987 | Dassler et al. | 36/134 |
| 4,644,672 | 2/1987 | Dassler et al. | 36/134 |
| 4,689,902 | 9/1987 | Lewis, Jr. | 36/131 |
| 4,727,661 | 3/1988 | Kuhn | 36/100 |
| 4,807,372 | 2/1989 | McCall | 36/135 |
| 4,833,796 | 5/1989 | Flemming | 36/134 |
| 4,856,211 | 8/1989 | Phillips | 36/131 |
| 4,887,369 | 12/1989 | Bailey et al. | 36/101 |
| 4,890,855 | 1/1990 | Graillat | 280/615 |
| 4,922,636 | 5/1990 | Chen | 36/127 |
| 4,940,263 | 7/1990 | Brischoux | 280/629 |
| 4,974,869 | 12/1990 | Muhlberger et al. | 280/625 |
| 4,979,740 | 12/1990 | Hall | 273/25 |
| 4,989,893 | 2/1991 | Kowatsch et al. | 280/625 |
| 5,029,405 | 7/1991 | DeHaitre | 36/134 |
| 5,040,820 | 8/1991 | Rigal et al. | 280/625 |
| 5,071,155 | 12/1991 | Stepanek et al. | 280/625 |
| 5,255,453 | 10/1993 | Weiss | 36/134 |
| 5,377,431 | 1/1995 | Walker et al. | 36/134 |
| 5,617,653 | 4/1997 | Walker et al. | 36/134 |

BREAK-AWAY CLEAT ASSEMBLY FOR ATHLETIC SHOES

RELATED PATENT APPLICATION

This is a continuation of application Ser. No. 08/416,219 filed on Apr. 4, 1995 , now U.S. Pat. No. 5,617,653 which is a continuation of U.S. Ser. No. 967,618, filed Oct. 28, 1992 abandoned; which is a continuation-in-part of U.S. Ser. No. 689,702, filed Apr. 15, 1991 now abandoned.

FIELD OF THE INVENTION

This invention relates generally to safety athletic foot wear having break-away cleats. More particularly, the invention relates to break-away cleats coupled to an athletic shoe which release in response to a predetermined force extending substantially lateral to the longitudinal axis of the cleats for reducing injuries to the athlete.

BACKGROUND OF THE INVENTION

Previous athletic shoes which have been designed to reduce soft tissue injury have included various configurations of fixed cleats designed to reduce injury. These shoes have not succeeded in preventing injuries. This can be seen because there are still tens of thousands of injuries each year to the knees and ankles of athletes.

Athletic cleated shoes are inherently dangerous because they grip the ground and do not allow the athlete's foot to release and dissipate harmful forces. This failure to release causes torque stresses and lateral strains on the legs of the athlete. These strains often lead to ligament damage requiring surgery and tendon augmentation. With the consequent incidence of pain and incapacity, there are millions of man-days lost at work, as well as millions of dollars spent on repairing these athletic injuries. The annual surgical cost of repairing knees of American high school football players is more than $50,000,000.00. Also, recovering patients undergo several weeks of post-operative immobilization followed by graduated rehabilitation regiments lasting from several weeks to several months. In the event of anterior cruciate ligament injuries, a common knee injury, full recovery is the exception.

Therefore, a stress reduction system is required which will allow the athlete's foot to "give away" under predetermined forces which prevent harm or injury to soft tissues and which does not compound injuries caused by the initial impact.

Athletes today also tape their ankles and tape their shoes to their feet. This is designed to give their ankles maximum support. The taping has sufficiently reduced ankle injuries, however, it has caused the forces which would have been absorbed by the ankle to translate upwardly toward the knee, thereby injuring the soft tissues of the knee including the ligaments.

A review of the literature about prophylactic taping of ankles along with the use of other ankle supports has shown an increase incidence of knee injuries. Because prophylactic ankle taping has limited lateral mobility without interfering with the flexion and extension of the shoes, the athletes have received the ideas of taping rather well. In most cases they are unaware, however, that taping their ankles increases the risk of injury to soft tissues including their knee ligaments.

Laterally placed prophylactic knee bracing has been studied during practice sessions and football games, as well as other sports activities. In several studies, it was found that the incidence rates of knee injuries were actually higher when the knee braces were worn as compared to the same activities without the knee braces. Furthermore, the use of knee braces has been associated with increased episodes of muscle cramping in the triceps surae muscle groups, requiring the constant attention of coaches and trainers to remind the players to wear the braces and to apply them correctly. This constant attention proved to be rather costly, and the use of knee braces has been dropped by many college and professional sports teams.

In addition, ankle injuries in the young athlete clearly illustrate the extreme difference between adult and childhood sport injuries. It has been found that ligaments in the skeletally immature athlete are stronger than the bones, so that ligament and other soft-tissue injuries are rare. With the tremendous increase in childhood and adolescent involvement in organized competitive athletics, the percentage of bone growth plate injuries attributable to sport is on the increase. The competitive athletes include football, basketball, soccer, baseball, lacrosse, tennis, rugby and field hockey. It would be most advantageous to provide shoes and foot supports for all of these athletic activities which would give way under certain forces in order to prevent the growth plate injuries which are currently being experienced.

Several shoes have been made with replaceable soles for various reasons. Examples of these assorted footwear are described in the following patents.

U.S. Pat. No. 3,538,628 issued on Nov. 10, 1970 to Arthur Einstein, Jr., discloses footwear with diverse footwear portions and means for enabling the selective separable securement to define a diverse combination footwear assemblies.

U.S. Pat. No. 4,114,295 issued on Sep. 19, 1978 to Schaefer discloses a convertible sport shoe designed to simplify the conversion of a convertible sport shoe to many different sports. Disclosed is a description of a fitting inter engagement of the sports device on the convertible sport shoe, thereby producing a so called "uni-sport shoe" which may be used for roller skating, ice skating and stilt walking.

U.S. Pat. No. 4,279,083 issued on Jul. 21, 1981 to Dilg discloses a shoe construction including a shoe body having a separable shoe sole utilizing velcro for enabling attachment and detachment of the replaceable sole. It is disclosed that as one sole wears out, a second sole may be replaced.

U.S. Pat. No. 4,317,294 issued on Mar. 2, 1982 to Goodyear discloses a replaceable shoe sole having a midsole and an out-sole which could be easily and selectively removed and replaced by an out-sole having a new or distinctive tread pattern.

U.S. Pat. No. 4,377,042 issued on Mar. 22, 1983 to Bauer discloses an athletic shoe with a removable out-sole. Each shoe has an insole and an out-sole which are attached to one another with a bead-and-recessed mechanically detachable locking member. His invention enables the replacement of soles.

U.S. Pat. No. 4,420,894 issued on Dec. 20, 1983 to Glassman discloses a shoe having an insole with an upper and an out-sole, designed to be able to receive new soles to be placed on the shoe. The embodiments disclosed allow for the complete replacement of a shoe sole.

U.S. Pat. No. 4,439,935 issued on Apr. 3, 1984 to Kelly disclose a convertible high style footwear in which a shoe base is interchangeable connected to a shoe upper which allows the interchange of a new vamp to meet fashion needs.

U.S. Pat. No. 4,689,902 issued on Sep. 1, 1987 to Lewis, Jr. discloses a break away riding boot with lengthwise pleats down the back of the boot secured together by velcro fasteners. In the event a rider falls from a horse and the rider's foot is caught in a stirrup, the velcro fasteners burst open allowing the pleats to unfold so that the rider's foot can be substantially instantaneously released from the boot thereby reducing the risk of injury. Although this patent indicates a safety feature, it is designed for a rider's boot to break away along the calf of the boot, and does not mention a break away sole or cleats attached to the bottom of the boot.

U.S. Pat. No. 4,887,369 issued Dec. 19, 1989 to Bailey et al discloses a convertible shoe with changeable shoe tops and heels indicating an upper vamp portion with fasteners for removably attaching various shoe tops to various shoe bottoms.

In view of the above, it would be advantageous for an athlete to have available to him or her a shoe with break-away cleats which substantially reduces injuries. Accordingly, there exist a need for improved cleated athletic shoes and cleats in which the cleats will release in response to a predetermined substantially lateral force which can cause soft tissue injuries or other injuries.

SUMMARY OF THE INVENTION

A primary object of the present invention is to provide athletic shoes with cleats which are responsive to predetermined lateral load forces to permit the cleats of the shoe to break away from the upper shoe body to reduce injuries.

The foregoing objects are basically attained by providing a cleat assembly adapted to be coupled to an athletic shoe with an upper body portion and a sole, comprising a cleat having a longitudinal axis; a base member for supporting the cleat on the sole of an athletic shoe; and a coupling member, associated with the base member and the cleat, for coupling the cleat to the base member, and for releasing the cleat from the base in response to a predetermined force which is directed substantially laterally of the longitudinal axis and which is lower than a lateral force which will cause injury to the athlete wearing the shoe.

BRIEF DESCRIPTION OF THE DRAWINGS

The nature and extent of the present invention will be clear from the following detailed description of the particular embodiments thereof, taken in conjunction with the appendant drawings, in which.

DETAILED DESCRIPTION OF THE INVENTION

Initially referring to FIGS. 1–10, a cleat assembly 10 in accordance with a first embodiment of the present invention is illustrated which is removably coupled to a conventional athletic shoe 12. Cleat assembly 10 is designed to replace existing, conventional screw type cleats which are used with conventional athletic shoes.

Figure 6:
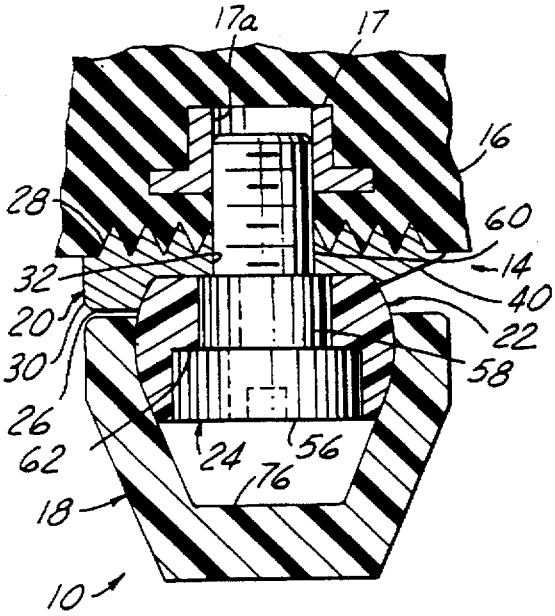
FIG. 6 is an enlarged, partial cross-sectional view of a break away or releasable cleat assembly attached to the left shoe taken along section line 6—6 of FIG. 3.
Figure 7:
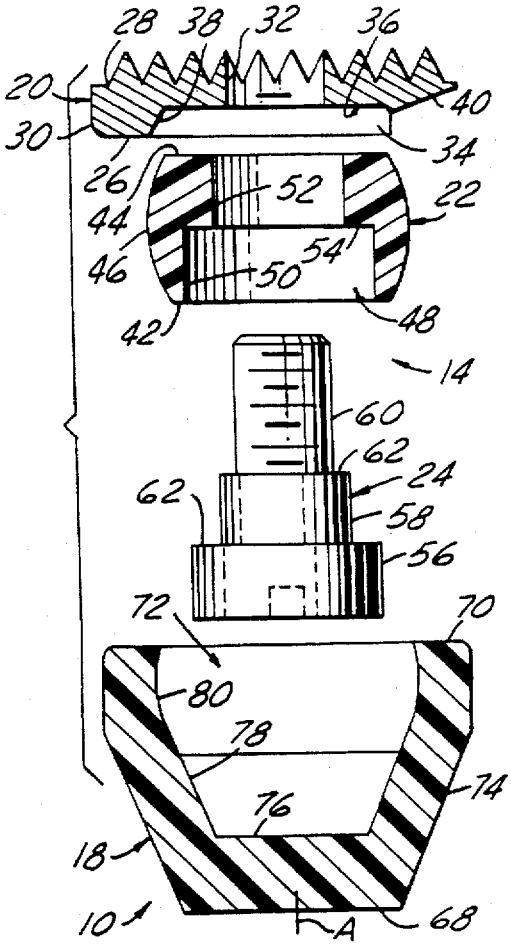
FIG. 7 is an exploded cross-sectional view of the break away or releasable cleat assembly of FIG. 6.

As particularly seen in FIGS. 6 and 7, cleat assembly 10 includes a base or bearing assembly 14 for attaching cleat assembly 10 to sole 16 of shoe 12, and a cleat 18 releasably coupled to base assembly 14 which releases or breaks away from base assembly 14 after the athlete has been subjected to a predetermined force substantially lateral to the longitudinal axis of cleat assembly 10. However, cleat assembly 10 is designed such that cleat 18 will not release from base assembly 14 during normal use of shoe 12 by the athlete.

Base assembly 14 includes a support housing 20, a coupling ring 22, and a threaded fastener 24. Base assembly 14 is designed to be rigidly fastened to sole 16 of shoe 12. Preferably, embedded in sole 16 of shoe 12 is a conventional metal insert 17 with a threaded bore 17*a* for threadedly receiving fastener 24 therein to rigidly secure base assembly 14 to sole 16 of shoe 12.

Support housing 20 is preferably made of a metallic material such as aluminum. However, support housing 20 can be made of a ring plastic material or any other suitable rigid material. Support housing 20 is illustrated as having a generally octagon shape when viewed in plan view. Of course, it would be apparent to those skilled in the art that support housing 20 can have a variety of shapes such as circular, square, etc. Support housing 20 includes a lower surface 26, an upper surface 28, an outer side surface 30 extending between surfaces 26 and 28, and a centrally located, axially extending bore 32 for receiving fastener 24 therethrough.

Figure 9:
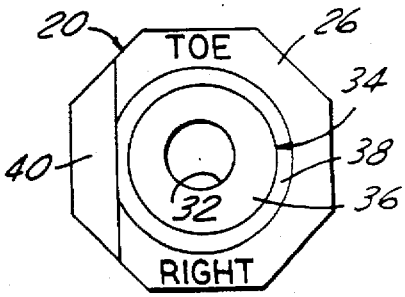
FIG. 9 is a bottom plan view of a support housing of the cleat assembly of FIGS. 1–8.

As seen in FIGS. 7 and 9, lower surface 26 of support housing 20 includes a circular recess 34 for receiving a portion of coupling ring 22 therein. Circular recess 34 is concentric with bore 32, and has a flat doughnut shaped bottom surface 36 and an annular side surface 38 extending downwardly from bottom surface 36. Annular side surface 38 has an inwardly facing concaved curvature oriented about the longitudinal axis of support housing 20.

Lower surface 26 also includes an inclined surface or ramp 40 sloping outwardly and upwardly from one edge of circular recess 34. Specifically, inclined surface 40 extends between outer side surface 30 and inner annular side surface 38. Accordingly, the height of the portion of annular side surface 38 along inclined surface 40 is substantially shorter than the remaining portion of annular surface 38. In other words, a portion of annular surface 38 is removed or cut out along inclined surface 40.

Figure 10:
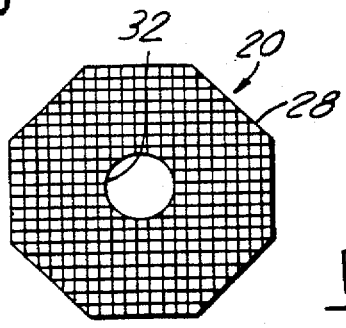
FIG. 10 is a top plan view of the support housing of the cleat assembly of FIG. 9.
Figure 11:
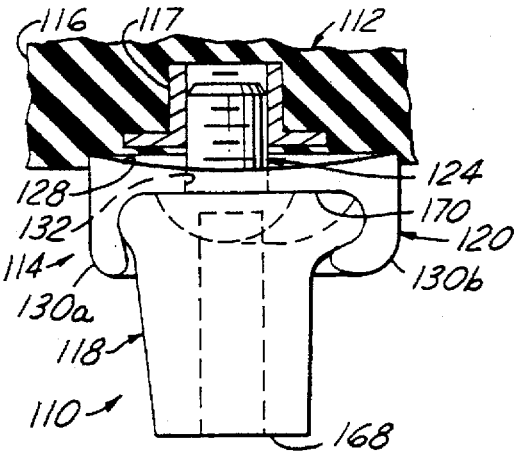
FIG. 11 is a front elevational view of a second embodiment of a cleat assembly in accordance with the present invention.
Figure 12:
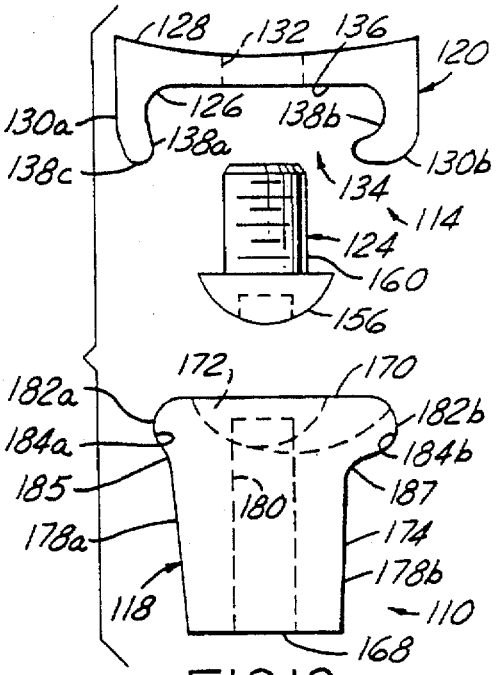
FIG. 12 is an exploded front elevational view of the cleat assembly of FIG. 11.
Figure 13:
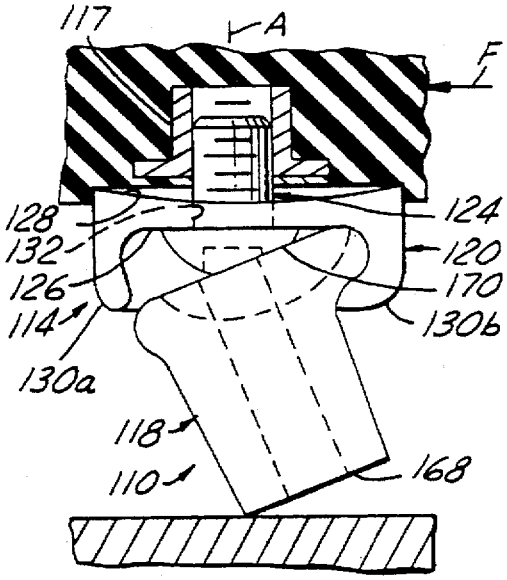
FIG. 13 is a front elevational view of the cleat assembly of FIGS. 11 and 12 with the cleat being rotated from the support housing after the athlete has been subjected to a predetermined force substantially lateral to the longitudinal axis of the cleat assembly.
Figure 14:
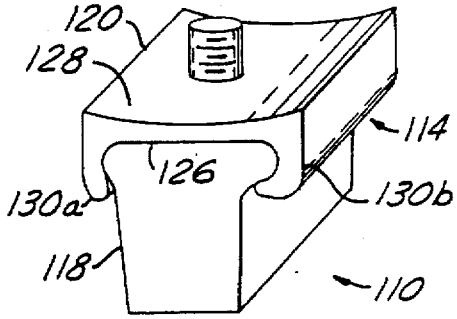
FIG. 14 is a front perspective view of the cleat assembly of FIG. 11.
Figure 15:
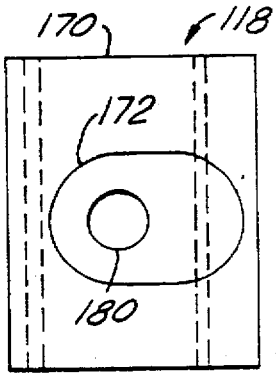
FIG. 15 is a top plan view of the cleat of FIGS. 11–14.
Figure 16:
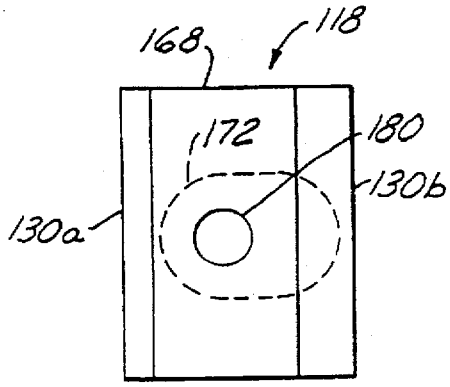
FIG. 16 is a bottom plan view of the cleat of FIGS. 11–15.
Figure 17:
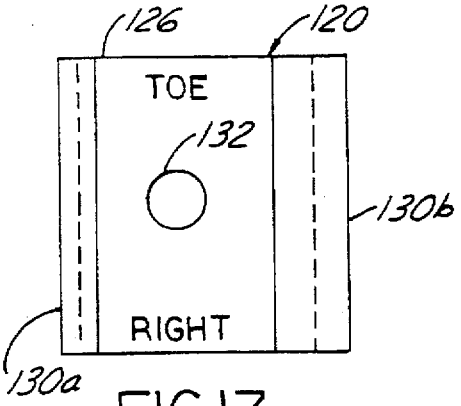
FIG. 17 is a bottom plan view of the support housing of FIGS. 11–13.
Figure 18:
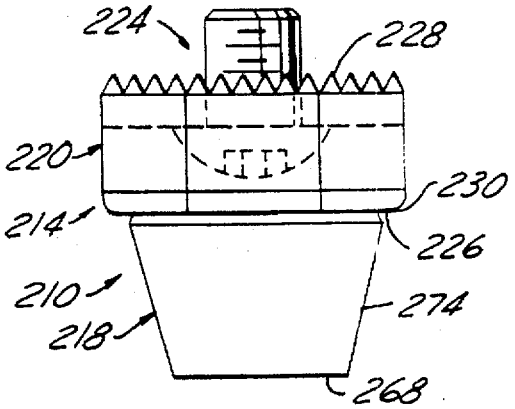
FIG. 18 is a front elevational view of a third embodiment of a cleat assembly in accordance with the present invention.
Figure 19:
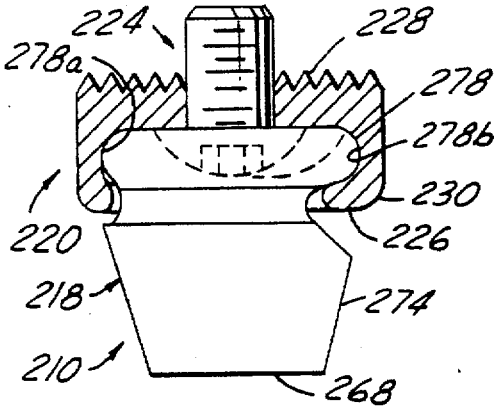
FIG. 19 is a longitudinal cross-sectional view of the cleat assembly of FIG. 18 with the cleat and fastener shown in elevation.
Figure 20:
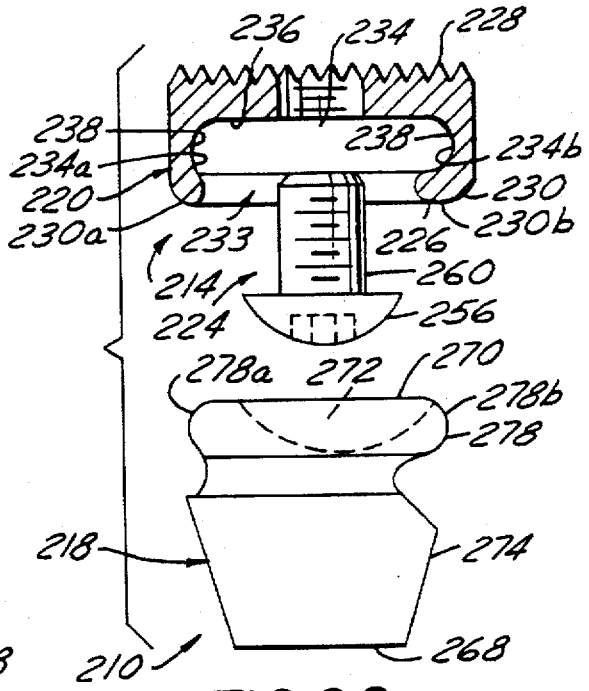
FIG. 20 is an exploded cross-sectional view of the cleat assembly of FIGS. 18 and 19 with the cleat and fastener shown in elevation.
Figure 21:
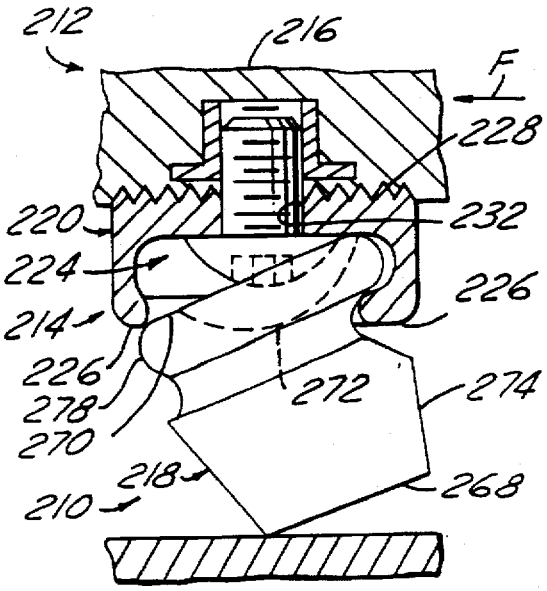
FIG. 21 is a cross-sectional view of the cleat assembly of FIGS. 18–20 with cleat being rotated from the support housing after the athlete has been subjected to a predetermined force substantially lateral to the longitudinal axis of the cleat assembly.
Figure 22:
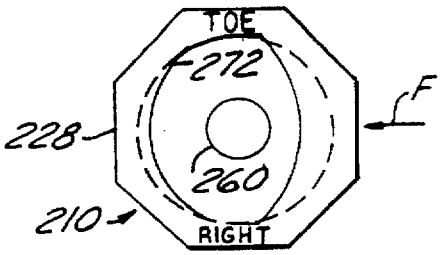
FIG. 22 is a bottom plan view of the support housing of FIGS. 18–21.
Figure 23:
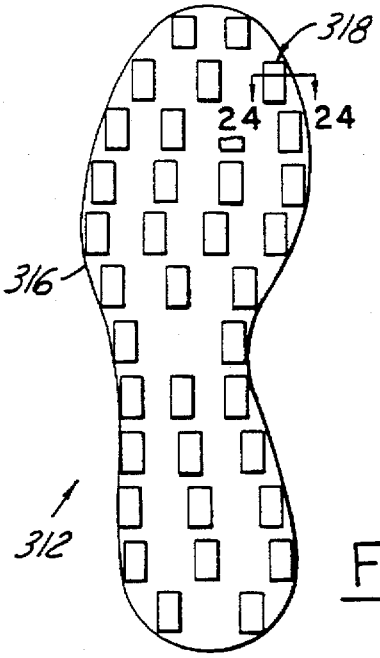
FIG. 23 is a bottom plan view of a right athletic shoe with break away or releasable cleats in accordance with a fourth embodiment of the present invention.
Figure 24:
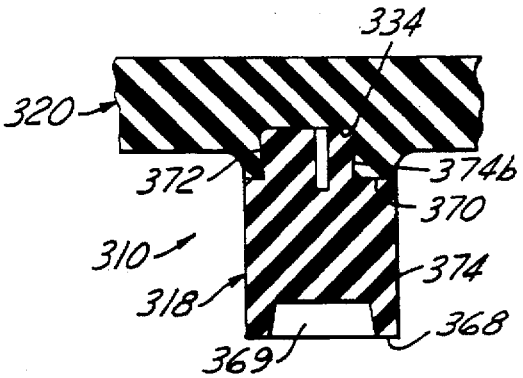
FIG. 24 is an enlarged, front, partial cross-sectional view taken along line 24—24 of the right athletic shoe of FIG. 23.

As seen in FIG. 10, upper surface 28 of support housing 20 has a knurled surface, i.e, a plurality of pyramid shaped projections with sharp points, for securely engaging the bottom surface of sole 16 of shoe 12 to prevent rotation therebetween when base assembly 14 is rigidly coupled to shoe 12.

Referring again to FIG. 7, coupling ring 22 is preferably made of a hard, rigid plastic material such as nylon or Teflon. Of course, coupling ring 22 can be made of any rigid material such as metal. Coupling ring 22 is substantially doughnut shaped, and includes a lower surface 42, an upper surface 44, an annular outer side surface 46 extending between lower surface 42 and upper surface 44, and a centrally located, axially extending bore 48. Outer side surface 46 is convexly curved outwardly from the longitudinal axis of coupling ring 22.

As seen in FIG. 7, bore 48 has a first cylindrical portion 50 and a second cylindrical portion 52. First cylindrical portion 50 is adjacent lower surface 42, while second cylindrical portion 52 is adjacent upper surface 44. First and second cylindrical portions 50 and 52 are concentrically arranged about the longitudinal axis of coupling ring 22 with first cylindrical portion 50 having a larger diameter than second cylindrical portion 52. First cylindrical portion 50 is connected to second cylindrical portion 52 by an annular shoulder 54 extending substantially perpendicular to the longitudinal axis of coupling ring 22.

Threaded fastener 24 is preferably a stainless steel shoulder screw which includes a cylindrical head portion 56, a cylindrical shoulder portion 58 extending from head portion 56, and a threaded shaft 60 extending from shoulder portion 58. The junction between shoulder portion 58 and shaft 60 forms an annular ledge 62.

Figure 8:
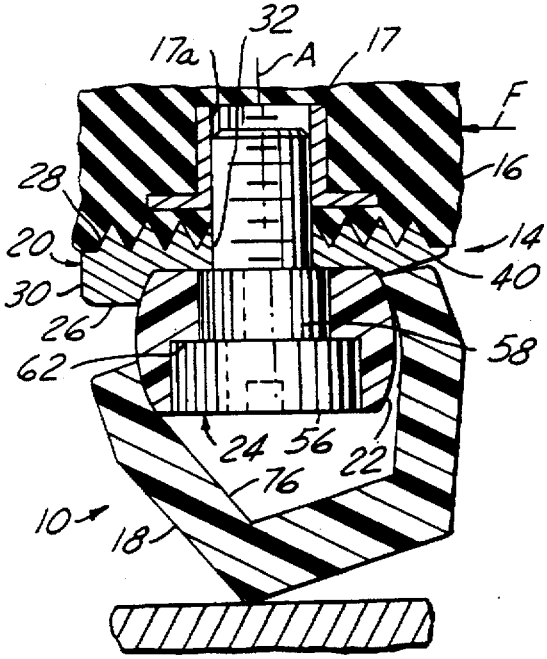
FIG. 8 is an enlarged, partial cross-sectional view of the cleat assembly of FIGS. 1–7 with the cleat being rotated from the support housing after the athlete has been subjected to a predetermined force substantially lateral to the longitudinal axis of the cleat assembly.

As seen in FIGS. 6 and 8, threaded fastener 24 is received in bores 32 and 48 of support housing 20 and coupling ring 22, respectively. In particular, head portion 56 and shoulder portion 58 are received in first cylindrical portion 50 and second cylindrical portion 52, respectively, of bore 48 of coupling ring 22, while shaft 60 extends through bore 32 of support housing 20 into threaded engagement with metal insert 17.

The diameter of head portion 56 of fastener 24 is preferably slightly smaller than the diameter of the first cylindrical portion 50 of bore 48. Also, the diameter of shoulder portion 58 of fastener 24 is slightly smaller than the diameter of second cylindrical portion 52 of bore 48. In addition, the axially length of shoulder portion 58 is slightly larger than the axial length of second cylindrical portion 52 of bore 48. Accordingly, coupling ring 22 freely rotates about fastener 24 when base assembly 14 is coupled to sole 16 of shoe 12. Specifically, upon attaching base assembly 14 to sole 16, ledge 62 of shoulder portion 58 will abut against bottom surface 36 of support housing 20 to limit inward movement of threaded fastener 24 into sole 16. Coupling ring 22 freely rotates about fastener 24, since the axial length of shoulder portion 58 is slightly larger than the axial length of second cylindrical portion 52 of bore 48, and the diameters of head portion 56 and shoulder portion 58 are slightly smaller than the respective diameters of cylindrical portions 50 and 52.

Cleat 18 is preferably made of a hard, rigid plastic material such as nylon, polycarbonate or Teflon. The shape of cleat 18 is shown as a truncated cone with an octagonal cross section. However, it will be apparent to those skilled in the art that cleat 18 can have a variety of cross-sectional shapes including rectangular, square, circular, etc.

As seen in FIG. 7, cleat 18 has a lower surface 68 for contacting the ground, an upper surface 70 with a recess 72 for releasably engaging coupling ring 22 of base assembly 14, and an outer side surface 74 extending between lower surface 68 and upper surface 70.

Recess 72 includes a flat bottom surface 76 an inwardly facing annular side surface 78 with a curved portion 80 of surface 78 being concaved inwardly. The curvature of the concaved portion 80 is substantially identical to the curvature of the convexly curved, outer side surface 46 of coupling ring 22. However, the diameter of concaved portion 80 is slightly smaller than the diameter of the convexly curved side surface 46 of coupling ring 22 so that a firm snap fit or friction fit secures cleat 18 onto coupling ring 22. This snap-fit rigidly retains cleat 18 on coupling ring 22 so as to rotate along with coupling ring 22.

During normal use, shoe 12 with cleat 18 will not release or break away from base assembly 14. However, if an athlete wearing shoe 12 with cleat assemblies 10 is hit with a sufficient lateral force F to cause soft tissue damage, then cleat 18 will rotate off coupling ring 22 to release cleat 18 from base assembly 14. In other words, cleat 18 will release from base assembly 14 when cleat 18 is firmly planted in the ground or turf and a force greater than the release threshold is transmitted substantially lateral to the longitudinal axis A of cleat assembly 10 as seen in FIG. 8. The release threshold should be less than that of any substantially lateral force which would likely cause injury to the athlete wearing the shoe.

Figure 1:
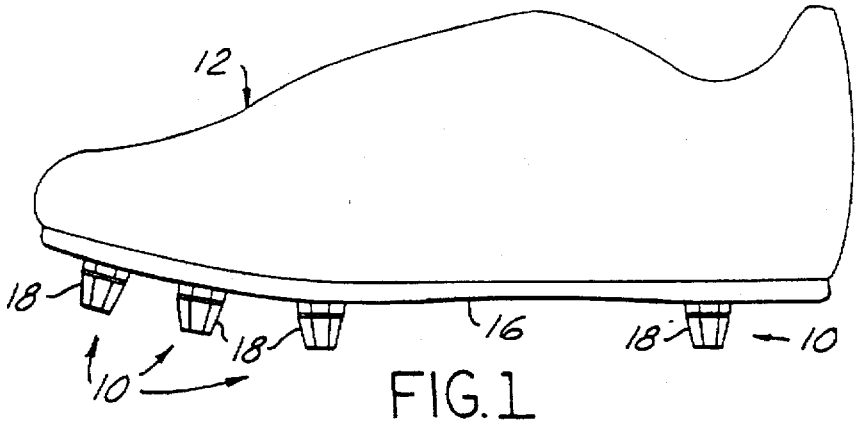
FIG. 1, is a right side elevational view of an athletic shoe with break away or releasable cleat assemblies in accordance with a first embodiment of the present invention.
Figure 2:
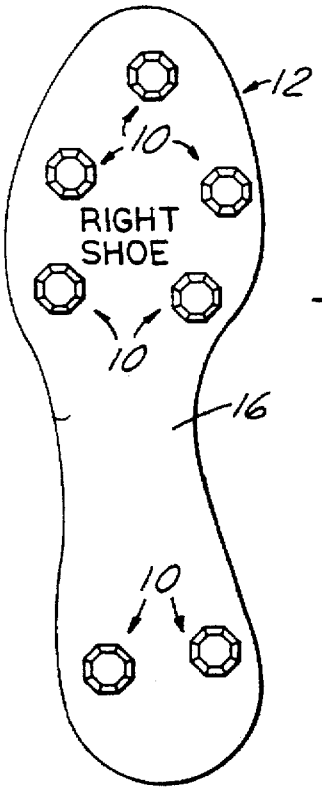
FIG. 2 is a bottom plan view of a right athletic shoe with break away or releasable cleat assemblies in accordance with the first embodiment of the present invention.
Figure 3:
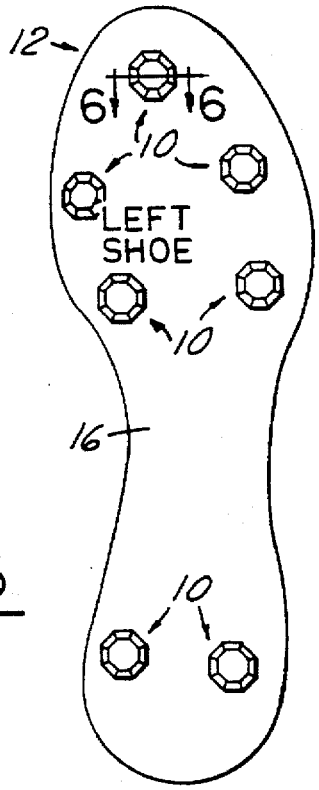
FIG. 3 is a bottom plan view of a left athletic shoe with break away or releasable cleat assemblies in accordance with the first embodiment of the present invention.
Figure 4:
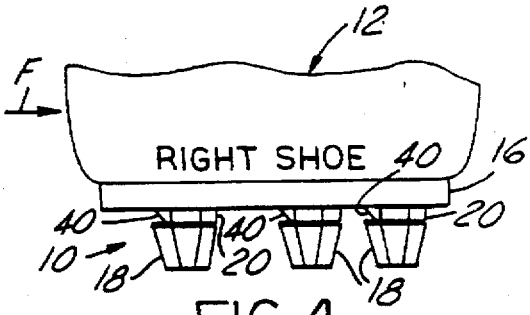
FIG. 4 is a partial, front elevational view of the right athletic shoe with break away or releasable cleat assemblies of FIG. 2.
Figure 5:
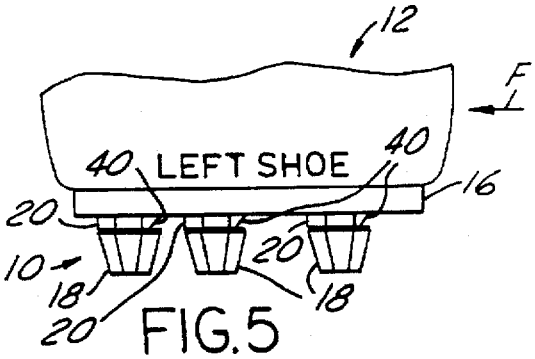
FIG. 5 is a partial, front elevational view of the left athletic shoe with break away or releasable cleat assemblies of FIG. 3.

In the preferred embodiment of FIGS. 1–10, cleat assembly 10 is designed to release only when the substantially lateral force or impact F is directed on the side of shoe 12 in which ramps 40 are facing. In particular as seen in FIGS. 4 and 5, all of the ramps 40 are arranged on sole 16 of shoe 12 so that the ramps 40 face towards the outside edge of shoe 12, i.e., the edge facing away from the body, for permitting cleat 18 to rotate outwardly off of coupling ring 22.

To adjust the release threshold of cleat 18 from shoe 12, the diameter of concaved portion 80 of recess 72 can be enlarged by increments of about 0.001 inch to lower the release threshold, or diminished by increments of about 0.001 inch to increase the release threshold. In other words, cleat 18 can be manufactured with a variety of release thresholds to satisfy the needs of a particular individual, i.e., the individuals weight, height, level of skill, age and other relevant factors. For example, cleat 18 can be color coded to indicate the particular release threshold.

To ensure that cleat assembly 10 is correctly attached to sole 16, support housing 20 is provided with indica indicating the correct orientation of supporting housing 20. For example, support housing 20 can have either "right" or "left" printed thereon along with either "toe" or "heel" to indicate which shoe the support housing 20 should be attached to and the orientation thereof, It will be apparent to those skilled in the art that cleat assembly 10 can be adapted for any sports activity which utilizes a cleated athletic shoe. For example, if cleat assembly 10 were used in baseball, then the ramp 40 in the support housing 20 would be rotated 90° from the example shown in FIGS. 1–10 so that ramp 40 would face the toe of shoe 12 for releasing cleat 18 during sliding into a base.

Cleat Assembly 110 of FIGS. 11–17

Referring now to FIGS. 11–17, a cleat assembly 110 in accordance with a second embodiment of the present invention is illustrated, and includes a base assembly 114 adapted to be attached to athletic shoe 112, and a cleat 118. One significant difference between cleat assembly 110 and cleat assembly 10 is that cleat 118 does not rotate about the longitudinal axis of cleat assembly 110 during normal use, but rather is stationary during normal use.

Base assembly 114 includes a support housing 120 and a threaded fastener 124 for rigidly and removably coupling cleat assembly 110 to sole 116 of shoe 112.

Support housing 120 is preferably made of a metallic material such as aluminum, and includes a lower surface 126, a curved upper surface 128 and a pair of downwardly and inwardly extending arms **130*a* and 130*b*. A centrally located bore 132 extends axially between lower surface 126 and upper surface 128 for receiving threaded fastener 124** therethrough.

Arms **130*a* and 130*b* form a rectangular recess 134 for receiving a portion of cleat 118 therein. Recess 134 includes a flat bottom surface 136, a pair of curved side surfaces 138*a* and 138*b* extending downwardly at opposite ends of bottom surface 136, and a flat surface 138*c* extending downwardly and inwardly from curved surface 138*a***.

Curved surface **138*a* is formed by inwardly extending arm 130*a*, while curved surface 138*b* is formed by inwardly extending arm 130*b*. Curved surfaces 138*a* and 138*b* are diametrically opposed from each other with the length of the curved surface 138*a* being smaller than the length of curved surface 138*b*. In other words, the curvatures of curved surfaces 138*a* and 138*b* are substantially identical, except that the arc of curved surface 138*b* is greater in length than the length of the arc of curved surface 138*a*. Arm 130*a* with curved surface 138*a* and flat surface 138*c* does not extend as far inwardly towards the center of recess 134 as does arm 130*b* with curved surface 138*b*. Accordingly, arm 130*b* extends inwardly towards the center of support housing 120 so as to form a larger lip than the lip formed by arm 130*a***.

Support housing 120 is somewhat flexible so that when support housing 120 is attached to sole 116 by fastener 124, the curved upper surface 128 can be selectively compressed against sole 116 to adjust the release threshold of cleat 118. In other words, tightening fastener 124 into insert 117 will cause curved upper surface 128 to flatten, and arms **130*a* and 130*b* to move closer together, narrowing recess 134. Thus, fastener 124** can be adjusted to regulate the release threshold.

Fastener 124 is a conventional screw made of a metallic material such as stainless steel. Threaded fastener 124 has a head 156 and a threaded shaft 160. Threaded shaft 160 is threadedly received in a threaded opening in sole 116 of athletic shoe 112 for fixedly coupling support housing 120 to athletic shoe 112. In particular, threaded shaft 160 is received in bore 132 of support housing 120 and then threaded into a hole in sole 116 of athletic shoe 112.

Cleat 118 is preferably made of a plastic material such as a high-impact resistent plastic resin such as polycarbonate or Teflon or Zytel. Cleat 118 has a flat lower surface 168 for contacting the ground, an upper surface 170 with an oblong recess 172, and a rectangular side surface 174 extending between lower surface 168 and upper surface 170. Recess 172 is sized to accommodate head 156 of fastener 124 when cleat 118 is received in recess 134 of support housing 120, and to avoid contacting head 156 of fastener 124 during release of cleat 118 from housing 120.

Side surface 174 has a pair of flat, opposite sides 176*a* and 176*b* extending downwardly and inwardly from upper surface 170 and a pair of flat opposite sides 178*a* and 178*b*. Sides 176*a* and 176*b* have projections 182*a* and 182*b*, respectively, extending outwardly at the upper ends of sides 176*a* and 176*b*. Projections 182*a* and 182*b* are convexly curved to be received in recess 134 against curved surfaces 138*a* and 138*b*, respectively. The curvatures of portions 184*a* and 184*b* of projections 182*a* , and 182*b* are substantially the same as the curvatures of curved surfaces 138*a* and 138*b*. Curved portion 184*a* of projection 182*a* is connected to side 178*a* by a reverse curved surface 185, while curved portion 184*b* of projection 182*b* is connected to side 178*b* by a flat surface 186 which extends inwardly and slightly downwardly and joins a reverse curved surface 187. Projection 182*b* extends outwardly from side 178*b* greater than does projection 182*a* does from side 178*a*.

Optionally, cleat 118 can have a central, longitudinally extending bore 180 for receiving a tool therethrough to tighten fastener 124 without removing cleat 118 from housing 120. Bore 180 can be provided with a lowered tapered portion (not shown) for receiving a plug (not shown) to prevent dirt from clogging bore 180.

It will be apparent to those skilled in the art that cleat assembly 110 can be adapted for any sports activity which utilizes a cleated athletic shoe. For example, if cleat assembly 110 were used in baseball, then support housing 120 would be rotated 90° from the example shown in FIGS. 11–17 so that arm 130*a* would face the toe of shoe 112 for releasing cleat 118 during sliding into a base.

Cleat Assembly 210 of FIGS. 18–22

Referring now to FIGS. 18–22, a cleat assembly 210 in accordance with a third embodiment of the present invention is illustrated. Cleat assembly 210 is substantially similar to cleat assembly 110, except that cleat 218 and support housing 220 of cleat assembly 210 have been modified to illustrate a conical shaped cleat instead of a rectangular cleat.

Base assembly 214 includes a support housing 220 and a threaded fastener 224 for rigidly and removably coupling cleat assembly 210 to sole 216 of shoe 212.

Support housing 220 is preferably made of a metallic material such as aluminum, or a hard rigid plastic material. Support housing 220 includes a lower surface 226, an upper surface 228 and a continuous downwardly and inwardly extending wall 230. A centrally located bore 232 extends axially between lower surface 226 and upper surface 228 for receiving threaded fastener 224 therethrough.

Wall 230 has a pair of crescent shaped lips 230*a* and 230*b* forming an opening 233 and a pair of crescent shaped recesses 234*a* and 234*b* for receiving portions of cleat 218 therein. Specifically, opening 233 is formed by reducing the inward length along a portion of wall 230. Lips 230*a* and 230*b* are diametrically opposed from each other with lip 230*a* being smaller than lip 230*b* so that the portion of the cleat 218 under lip 230*a* will pop out when the athlete is subjected to a predetermined force greater than the release threshold. Recess 234 includes a flat bottom surface 236 and an annular curved side surface 238. Curved annular surface 238 is formed by inwardly extending lips 230*a* and 230*b*.

Fastener 224 is a conventional screw made of a metallic material such as stainless steel. Threaded fastener 224 has a head 256 and a threaded shaft 260. Threaded shaft 260 is threadedly received in a threaded opening in sole 216 of athletic shoe 212 for fixedly coupling support housing 220 to athletic shoe 212. In particular, threaded shaft 260 is received in bore 232 of support housing 220 and then threaded into a hole in sole 216 of athletic shoe 212.

Cleat 218 is preferably made of a plastic material such as a high-impact resistent plastic resin such as polycarbonate or Teflon or Zytel. Cleat 218 has a lower surface 268 for contacting the ground, an upper surface 270 with a oblong recess 272, and a side surface 274 extending between lower surface 268 and upper surface 270. Recess 272 is sized to accommodate the head 256 of fastener 224 when cleat 218 is received in recess 234 of support housing 220 and to permit unobstructed movement of cleat 218 when rotated out of housing 220.

The upper portion of side surface 274 is reduced to form a continuous convexly curved projection 278. Projection 278 has a pair of diametrically opposed portions 278*a* and 278*b* for engaging lips 230*a* and 230*b*, respectively. Projection portion 278*b* is larger than projection portion 278*a*. In other words, side surface 274 of cleat 218 is reduced more along portion 278*a* and reduced less along portion 278*b*. Specifically, projection portions 278*a* and 278*b* are convexly curved to be received in crescent shaped recesses 234*a* and 234*b*, respectively.

Cleat Assembly 310 of FIGS. 23–29

Referring to FIGS. 23–29, a cleat assembly 310 in accordance with a fourth embodiment of the present invention is illustrated, and includes a cleat 318 of a high durometer material which is releasably coupled to a support housing 320 integrally formed in sole 316 of shoe 312.

Figure 25:
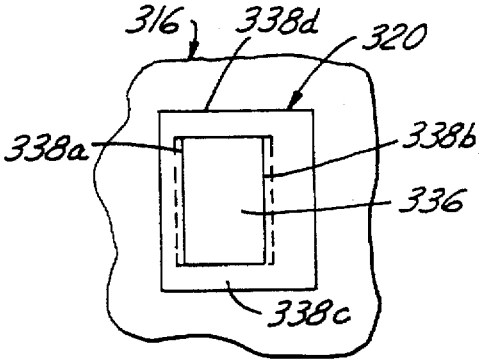
FIG. 25 is an enlarged, partial bottom plan view of the sole of the shoe of FIGS. 23 and 24 with a cleat removed.
Figure 26:
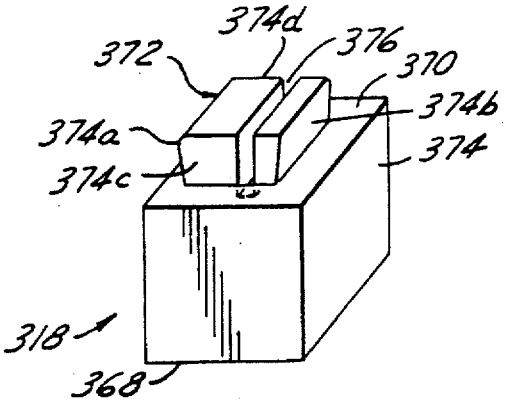
FIG. 26 is an enlarged, perspective view of a cleat in accordance with the fourth embodiment of the present invention.

Referring to FIG. 25, support housing 320 has a rectangular recess 334 with a flat bottom surface 336 and four side surfaces 338*a*, 338*b*, 338*c* and 338*d*. Side surfaces 338*a* and 338*b* slope downwardly and inwardly so that the width of the opening of recess 334 is smaller than the width of flat surface 336. Side surfaces 338*c* and 338*d* can be either perpendicular with flat surface 336 or slope downwardly and inwardly so as to narrow the length of the opening of recess 334.

Cleat 318 has a lower surface 368 with a rectangular recess 369 for engaging the ground, an upper surface 370 with an upwardly extending projection 372, and a rectangular side surface 374 extending between lower surface 368 and upper surface 370.

Projection 372 extends upwardly from upper surface 370 and is offset to one side of upper surface 370. Preferably, the left side is one half the width of the right side. Thus, the area of upper surface 370 on the left side of projection 372 is one half the area of upper surface 370 on the right side of projection 372. Alternatively, projection 372 can be centered on upper surface 370 with the areas on both sides of projection 372 being substantially equal.

Projection 372 is preferably rectangular in cross section with four side surfaces 374*a*, 374*b*, 374*c* and 374*d*. Side surfaces 374*a* and 374*b* slope upwardly and outwardly from upper surface 370 at substantially the same slope as side surfaces 338*a* and 338*b* of support housing 320. Side surfaces 374*c* and 374*d* can be either perpendicular or inclined upwardly and outwardly from upper surface 370 depending upon the slope of side surfaces 338*c* and 338*d* of recess 334. In other words, projection 372 and recess 334 have complementary mating shapes so that projection 372 fits securely in recess 334. Accordingly, the width and length of projection 372 are slightly larger than the width and length of recess 334 to provide a secure snap-fit or friction fit.

Projection 372 has a rectangular void area or groove 376 extending between side surfaces 374*c* and 374*d* to provide projection 372 with slight flexibility for insertion into recess 334. The length and width of projection 372 are dimensioned to be slightly larger than the length and width of recess 334 to provide a snap-fit or friction fit therebetween. In other words, groove 376 allows projection 372 to initially compress inwardly as projection 372 is inserted into recess 334, and then partially or fully expands against the side surfaces 338*a*–338*d* to ensure a firm connection therebetween.

In use, cleat 318 is positioned so that the narrow side of the projection 372 is toward the outside, i.e., away from the leg of the wearer, so that a lateral impact to the leg of the wearer will cause the leg to move inwardly towards the body, the cleat 318 will readily release from the recess 334 of the sole 316 of the shoe 312. In particular, when a sufficient lateral force is transmitted to the shoe, the projection on the top surface of the cleat will roll out of the recess 334.

Figure 27:
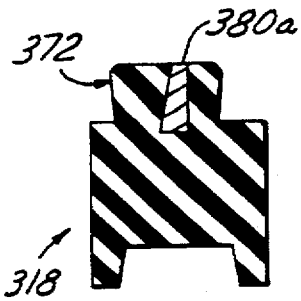
FIG. 27 is a cross-sectional view of a first modified cleat for use with the athletic shoe of FIG. 26.
Figure 28:
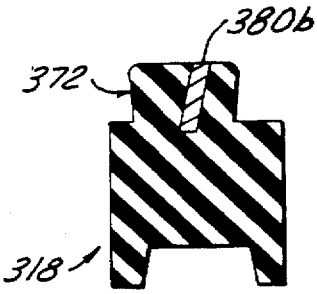
FIG. 28 is a cross-sectional view of a second modified cleat for use with the athletic shoe of FIG. 26.
Figure 29:
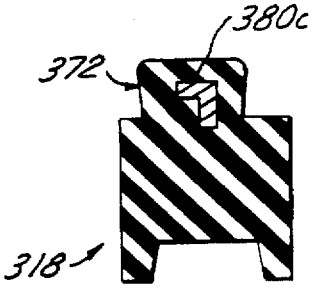
FIG. 29 is a third cross-sectional view of a modified cleat for use with the athletic shoe of FIG. 26.

As seen in FIGS. 27–29, various types of metal inserts 380*a*, 380*b* or 380*c* can be formed in projection 372 to increase the force required to release the cleat from recess 334 in sole 316 of shoe 312.

Figure 30:
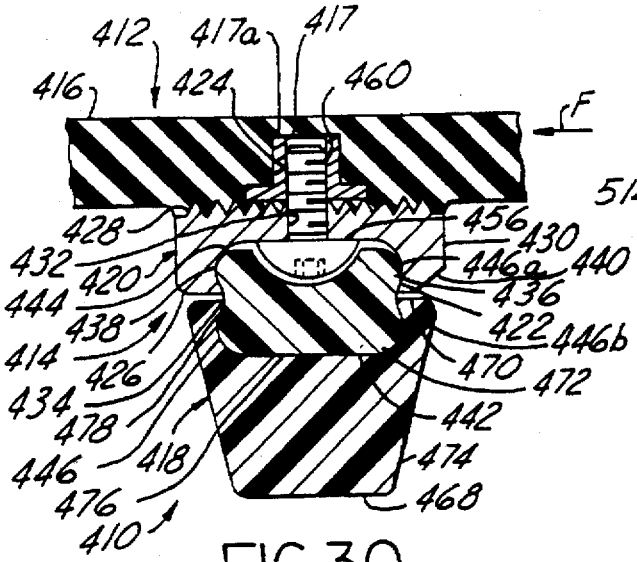
FIG. 30 is a longitudinal cross-sectional view of a fifth embodiment of the present invention.

Cleat Assembly 410 of FIG. 30

Referring now to FIG. 30, a cleat assembly 410 in accordance with a fifth embodiment of the present invention is illustrated, and includes a base or bearing assembly 414 for attaching cleat assembly 410 to sole 416 of shoe 412, and a cleat 418 releasably coupled to base assembly 414 which releases or breaks away from base assembly 414 after the athlete has been subjected to a predetermined force substantially lateral to the longitudinal axis of cleat assembly 410. However, cleat assembly 410 is designed such that cleat 418 will not release from base assembly 414 during normal use of shoe 412 by the athlete. Cleat assembly 410 is substantially identical to cleat assembly 10, except that base assembly 14 and cleat 18 have been slightly modified.

Base assembly 414 includes a support housing 420, a coupling ring 422, and a threaded fastener 424. Base assembly 414 is designed to be rigidly fastened to sole 416 of shoe 412. Preferably, embedded in sole 416 of shoe 412 is a conventional metal insert 417 with a threaded bore 417*a* for threadedly receiving fastener 424 therein to rigidly secure base assembly 414 to sole 416 of shoe 412.

Support housing 420 is preferably made of a metallic material such as aluminum. However, support housing 420 can be made of a ring plastic material or any other suitable rigid material. Support housing 420 is illustrated as having a generally truncated cone. Support housing 420 includes a lower surface 426, an upper surface 428, an outer side surface 430 extending between surfaces 426 and 428, and a centrally located, axially extending bore 432 for receiving fastener 424 therethrough.

Lower surface 426 of support housing 420 includes a circular recess 434 for receiving a portion of coupling ring 422 therein. Circular recess 434 is concentric with bore 432, and has a flat doughnut shaped bottom surface 436 and an annular side surface 438 extending downwardly from bottom surface 436. Annular side surface 438 has an inwardly facing concaved curvature oriented about the longitudinal axis of support housing 420.

Lower surface 426 also includes an inclined surface or ramp 440 sloping outwardly and upwardly from one edge of circular recess 434. Specifically, inclined surface 440 extends between outer side surface 430 and inner annular side surface 438. The height of the portion of annular side surface 438 is substantially uniform.

Upper surface 428 of support housing 420 has a knurled surface, i.e, a plurality of pyramid shaped projections with sharp points, for securely engaging the bottom surface of sole 416 of shoe 412 to prevent rotation therebetween when base assembly 414 is rigidly coupled to shoe 412.

Coupling ring 422 is preferably made of a hard, rigid plastic material such as nylon or Teflon. Of course, coupling ring 422 can be made of any rigid material such as metal. Coupling ring 422 is substantially cylindrical and includes a lower surface 442, an upper surface 444, and an annular outer side surface 446 extending between lower surface 442 and upper surface 444. Outer side surface 446 has a pair of convexly curved portions 446*a* and 446*b*. Upper surface 444 has a recess for accommodating a portion of fastener 424. The tolerances between curved portion 446*a* of coupling ring 422 and curved surface 438 of support housing 420 can be dimensioned so that coupling ring 422 either rotates within recess 434 or remains stationary in recess 434.

Threaded fastener 424 is preferably a stainless steel screw which includes a cylindrical head portion 456, and a threaded shaft 460 extending from head portion 456.

Cleat 418 is preferably made of a hard, rigid plastic material such as nylon, polycarbonate or Teflon. The shape of cleat 418 is preferably a truncated cone. However, it will be apparent to those skilled in the art that cleat 418 can have a variety of cross-sectional shapes including rectangular, square, circular, etc.

Cleat 418 has a lower surface 468 for contacting the ground, an upper surface 470 with a recess 472 for releasably engaging coupling ring 422 and an outer side surface 474 extending between lower surface 468 and upper surface 470.

Recess 472 includes a flat bottom surface 476 and an inwardly facing annular side surface 478 which is concaved inwardly. The curvature of the concaved surface 478 is substantially identical to the curvature of the convexly curved, outer side surface 446*b* of coupling ring 422. However, at least a portion of the diameter of concaved surface 478 is slightly smaller than the diameter of the convexly curved side surface 446*b* of coupling ring 422 so that a firm snap fit or friction fit secures cleat 418 onto coupling ring 422. This snap-fit rigidly retains cleat 418 on coupling ring 422 so that cleat 418 either rotates on coupling ring 422 or remains stationary with coupling ring 422. Moreover, depending on the tolerances of curved portions 446*a* and 446*b* of coupling ring 422, curved surface 438 of support housing 420 and curved surface 478 of cleat 418, coupling ring 422 will either release with cleat 418 or remain attached to support housing 420 when the athlete is subjected to a substantially lateral force greater than the release threshold of cleat 418.

During normal use, shoe 412 with cleat 418 will not release or break away from base assembly 414. However, if an athlete wearing shoe 412 with cleat assemblies 410 is hit with a sufficient lateral force F to cause soft tissue damage, then cleat 418 will rotate off coupling ring 422 to release cleat 418 from base assembly 414. In other words, cleat 418 will release from base assembly 414 when cleat 418 is firmly planted in the ground or turf and a force greater than the release threshold is transmitted substantially lateral to the longitudinal axis A of cleat assembly 410. The release threshold should be less than that of any substantially lateral force which would likely cause injury to the soft tissues of the athlete wearing the shoe.

Cleat assembly 410 is designed to release only when the substantially lateral force or impact F is directed on the side of shoe 412 in which ramps 440 are facing. In particular, all of the ramps 440 are arranged on sole 416 of shoe 412 so that the ramps 440 face towards the outside edge of shoe 412, i.e., the edge facing away from the body, for permitting cleat 418 to rotate outwardly off of coupling ring 422.

To adjust the release threshold of cleat 418 from coupling ring 422, the diameter of concaved surface 478 of recess 472 can be enlarged by increments of about 0.001 inch to lower the release threshold, or diminished by increments of about 0.001 inch to increase the release threshold. However, if it is preferred to have coupling ring 422 release with cleat 418, then the release threshold between coupling ring 422 and support housing 420 is adjusted by decreasing or increasing the diameter of curved surface **446*a* of coupling ring 422 relative to curved surface 438 of support housing 420. In other words, cleat 418 can be manufactured with a variety of release thresholds to satisfy the needs of a particular individual, i.e., the individuals weight, height, level of skill, age and other relevant factors. For example, cleat 418** can be color coded to indicate the particular release threshold.

To ensure that cleat assembly 410 is correctly attached to sole 416, support housing 420 can be provided with indica indicating the correct orientation of supporting housing 420. For example, support housing 420 can have either "right" or "left" printed thereon along with either "toe" or "heel" to indicate which shoe the support housing 420 should be attached to and the orientation thereof.

It will be apparent to those skilled in the art that cleat assembly 410 can be adapted for any sporting activity which utilizes a cleated athletic shoe. For example, if cleat assembly 410 were used in baseball, then the ramp 440 of support housing 420 would be rotated 90° from the example shown in FIG. 30 so that ramp 440 would face the toe of shoe 412 for releasing cleat 418 during sliding into a base.

Figure 31:
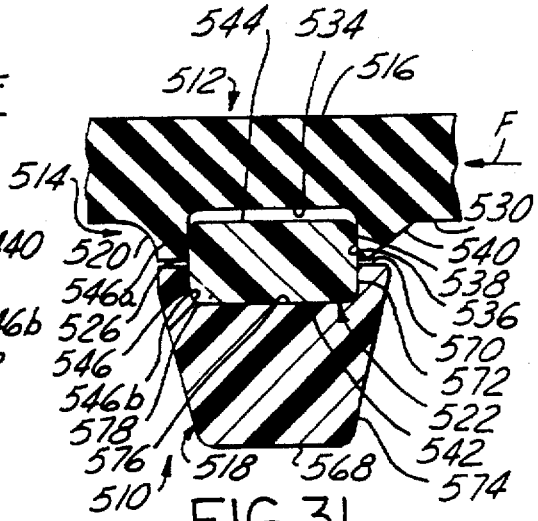
FIG. 31 is a longitudinal cross-sectional view of a sixth embodiment of the present invention.

Cleat Assembly 510 of FIG. 31

Referring now to FIG. 31, a cleat assembly 510 in accordance with a sixth embodiment of the present invention is illustrated, and includes a base or bearing assembly 514 for attaching cleat 518 to sole 516 of shoe 512, wherein cleat 518 releases or breaks away from base assembly 514 after the athlete has been subjected to a predetermined force substantially lateral to the longitudinal axis of cleat assembly 510. However, cleat assembly 510 is designed such that cleat 518 will not release from base assembly 514 during normal use of shoe 512 by the athlete. Cleat assembly 510 is substantially identical to cleat assembly 410, discussed above except that base assembly 510 have been modified so that a portion is integrally formed with sole 516. Thus, cleat assembly 510 will not be discussed or illustrated in detail.

Base assembly 514 includes a support housing 520 integrally formed with sole 516, and a coupling ring 522. Support housing 520 includes a lower surface 526 with a circular recess 534 for receiving a portion of coupling ring 522 therein. Circular recess 534 has a flat bottom surface 536 and an annular side surface 538 extending downwardly from bottom surface 536. Annular side surface 538 has an inwardly facing concaved curvature oriented about the longitudinal axis of support housing 520.

Lower surface 526 also includes an inclined surface or ramp 540 sloping outwardly and upwardly from one edge of circular recess 534. Specifically, inclined surface 540 extends between outer side surface 530 and inner annular side surface 538. The height of the portion of annular side surface 538 is substantially uniform.

Coupling ring 522 is preferably made of a hard, rigid plastic material such as nylon or Teflon. Of course, coupling ring 522 can be made of any rigid material such as metal. Coupling ring 522 is substantially cylindrical and includes a lower surface 542, an upper surface 544, and an annular outer side surface 546 extending between lower surface 542 and upper surface 544.

Outer side surface 546 has a pair of convexly curved or spherical portions **546*a* and 546*b*. Curved portion 546*a* is received in recess 534 of support housing 520 via a snap-fit. Curved portion 546*a* of coupling ring 522 and curved surface 538 or recess 534 can be dimensioned so that the tolerance will permit coupling ring 522 to either rotate in recess 534, or remain stationary in recess 534**.

Cleat 518 is preferably made of a hard, rigid plastic material such as nylon, polycarbonate or Teflon. The shape of cleat 518 is preferably a truncated cone. However, it will be apparent to those skilled in the art that cleat 518 can have a variety of cross-sectional shapes including rectangular, square, circular, etc.

Cleat 518 has a lower surface 568 for contacting the ground, an upper surface 570 with a recess 572 for releasably engaging curved portion 546b of coupling ring 522 and an outer side surface 574 extending between lower surface 568 and upper surface 570.

Recess 572 includes a flat bottom surface 576 an inwardly facing annular side surface 578 which is concaved inwardly. The curvature of the concaved portion 578 is substantially identical to the curvature of the convexly curved, outer side surface **546*b* of coupling ring 522. However, the diameter of concaved portion 576 is slightly smaller than the diameter of the convexly curved side surface 546*b* of coupling ring 522 so that a firm snap fit or friction fit secures cleat 518 onto coupling ring 522. This snap-fit rigidly retains cleat 518 on coupling ring 522 so that cleat 518 either rotates on coupling ring 522, or remains stationary with coupling ring 522. Moreover, depending on the tolerances of curved portions 546*a* and 546*b* of coupling ring 522, curved surface 538 of support housing 520, and curved surface 574 of cleat 518, coupling ring 522 will either release with cleat 518 or remain attached to support housing 520 when the athlete is subjected to a substantially lateral force greater than the release threshold of cleat 518**.

During normal use, shoe 512 with cleat 518 will not release or break away from base assembly 514. However, if an athlete wearing shoe 512 with cleat assemblies 510 is hit with a sufficient lateral force F to cause soft tissue damage, then cleat 518 will rotate off coupling ring 522 to release cleat 518 from base assembly 514. In other words, cleat 518 will release from base assembly 514 when cleat 518 is firmly planted in the ground or turf and a force greater than the release threshold is transmitted substantially lateral to the longitudinal axis A of cleat assembly 510. The release threshold should be less than that of any substantially lateral force which would likely cause injury to the soft tissues of the athlete wearing the shoe.

Cleat assembly 510 is designed to release only when the substantially lateral force or impact F is directed on the side of shoe 512 in which ramps 540 are facing. In particular, all of the ramps 540 are arranged on sole 516 of shoe 512 so that the ramps 540 face towards the outside edge of shoe 512, i.e., the edge facing away from the body, for permitting cleat 518 to rotate outwardly off of coupling ring 522.

To adjust the release threshold of cleat 518 from coupling ring 522, the diameter of concaved portion 578 of recess 572 can be enlarged by increments of about 0.001 inch to lower the release threshold, or diminished by increments of about 0.001 inch to increase the release threshold. Alternatively, if coupling ring 522 is to release with cleat 518, then the release threshold between coupling ring 522 and support housing 520 is adjusted by decreasing or increasing the diameter of curved surface 546*a* of coupling ring 522 relative to curved surface 538 of support housing 520. In other words, cleat 518 can be manufactured with a variety of release thresholds to satisfy the needs of a particular individual, i.e., the individuals weight, height, level of skill, age and other relevant factors. For example, cleat 518 can be color coded to indicate the particular release threshold.

To ensure that cleat assembly 510 is correctly attached to sole 516, support housing 520 can be provided with indica indicating the correct orientation of supporting housing 520. For example, support housing 520 can have either "right" or "left" printed thereon along with either "toe" or "heel" to indicate which shoe the support housing 520 should be attached to and the orientation thereof.

It will be apparent to those skilled in the art that cleat assembly 510 can be adapted for any sporting activity which utilizes a cleated athletic shoe. For example, if cleat assembly 510 were used in baseball, then the ramp 540 of support housing 520 would be rotated 90° from the example shown in FIG. 31 so that ramp 540 would face the toe of shoe 512 for releasing cleat 518 when sliding into a base.

Figure 32:
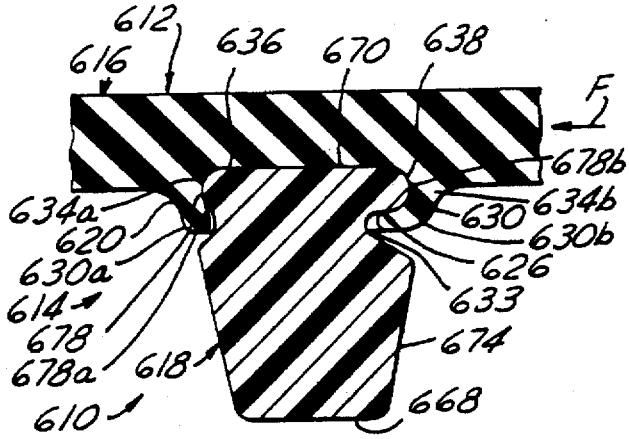
FIG. 32 is a longitudinal cross-sectional view of a seventh embodiment of the present invention.
Figure 32A:
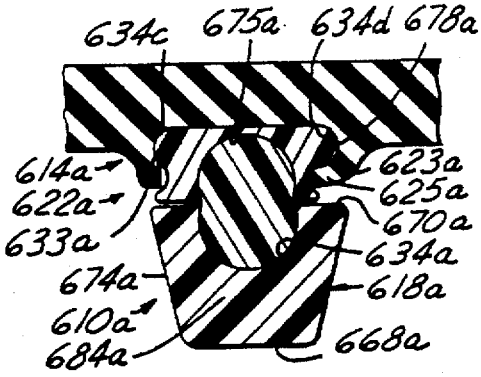
Figure 33:
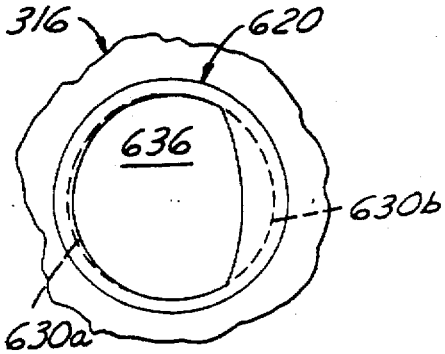
FIG. 33 is a bottom plan view of the support housing illustrated in FIG. 32.
Figure 34:
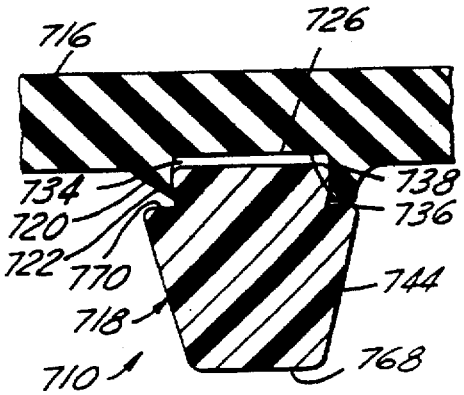
FIG. 34 is a longitudinal cross-sectional view of an eighth embodiment of the present invention.
Figure 35:
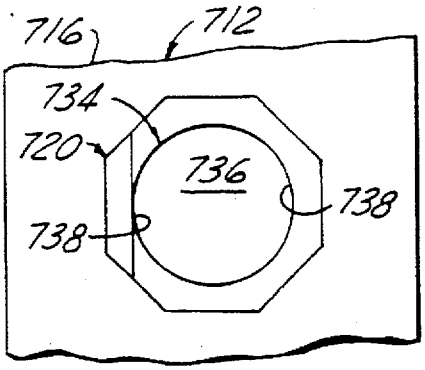
FIG. 35 is a bottom plan view of the support housing of FIG. 34.
Figure 36:
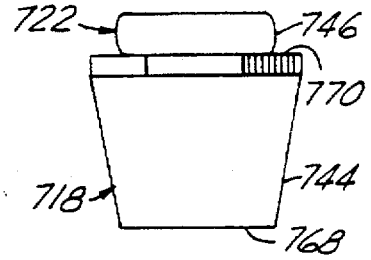
FIG. 36 is a side elevational view of the cleat of FIG. 34.
Figure 37:
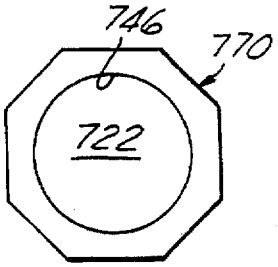
FIG. 37 is a top plan view of the cleat of FIG. 36.

Cleat Assemblies 610 and 610*a* of FIGS. 32, 32*a* and 33

Referring now to FIG. 32, a cleat assembly 610 in accordance with a seventh embodiment of the present invention is illustrated, and includes a base assembly 614 for attaching cleat 618 to sole 616 of shoe 612, which releases or breaks away from base assembly 614 after the athlete has been subjected to a predetermined force substantially lateral to the longitudinal axis of cleat assembly 610. However, cleat assembly 610 is designed such that cleat 618 will not release from base assembly 614 during normal use of shoe 612 by the athlete. Cleat assembly 610 is substantially identical to cleat assembly 210, except that base assembly 614 has been modified to be integrally formed with sole 616 instead of being a separate element as in cleat assembly 210. Thus, cleat assembly 610 will not be discussed or illustrated in detail herein.

Base assembly 614 has a support housing 620 integrally molded with sole 616. Support housing 620 includes a lower surface 626, and a continuous downwardly and inwardly extending wall 630.

Wall 630 has a pair of crescent shaped lips 630*a* and 630*b* forming an opening 633 and a pair of crescent shaped recesses 634*a* and 634*b* for receiving portions of cleat 618 therein. Specifically, opening 633 is formed by reducing the inward length along a portion of arm 630. Lips 630*a* and 630*b* are diametrically opposed from each other with lip 630*a* being smaller than lip 630*b* so that the portion of the cleat 618 under lip 630*a* will pop out when the athlete is subjected to a predetermined force greater than the release threshold. Recess 634 includes a flat bottom surface 636 and an annular curved side surface 638. Curved annular surface 638 is formed by inwardly extending lips 630*a* and 630*b*.

Cleat 618 is preferably made of a plastic material such as a high-impact resistent plastic resin such as polycarbonate or Teflon or Zytel. Cleat 618 has a lower surface 668 for contacting the ground, an upper surface 670 and a side surface 674 extending between lower surface 668 and upper surface 670.

The upper portion of side surface 674 is reduced to form a continuous convexly curved projection 678. Projection 678 has a pair of diametrically opposed portions 678*a* and 678*b* for engaging lips 630*a* and 630*b*, respectively. Projection portion 678*b* is larger than projection portion 678*a*. In other words, side surface 674 of cleat 618 is reduced more along portion 678*a* and reduced less along portion 678*b*. Specifically, projection portions 678*a* and 678*b* are convexly curved to be received in crescent shaped recesses 634*a* and 634*b*, respectively.

Referring now to FIG. 32*a*, a cleat assembly 610*a* is a hybrid of cleat assemblies 510 and 610, and includes a base or assembly 614*a* for attaching cleat 618*a* to sole 616*a* of shoe 612*a*, wherein cleat 618*a* releases or breaks away from base assembly 614*a* after the athlete has been subjected to a predetermined force substantially lateral to the longitudinal axis of cleat assembly 610*a*. However, cleat assembly 610*a* is designed such that cleat 618*a* will not release from base assembly 614*a* during normal use of shoe 612*a* by the athlete. Since cleat assembly 610*a* is a hybrid of cleat assemblies 510 and 610 discussed above, cleat assembly 510 will not be discussed or illustrated in detail.

Base assembly 614*a* has a support housing 620*a* integrally molded with sole 616*a*. Support housing 620*a* includes a lower surface 626*a*, and a continuous downwardly and inwardly extending wall 630*a*. Support housing 620*a* is identical to support housing 620 shown in FIGS. 32 and 33. Thus, coupling member 622*a* and cleat 618*a* release from support housing 620*a* in the same manner as discussed above.

Wall 630*a* has a pair of crescent shaped lips 630*c* and 630*d* forming an opening 633*a* and a pair of crescent shaped recesses 634*c* and 634*d* for receiving a portion of coupling ring 622*a* therein. Specifically, opening 633*a* is formed by reducing the inward length along a portion of arm 630*a*. Lips 630*c* and 630*d* are diametrically opposed from each other with lip 630*c* being smaller than lip 630*d* so that the portion of the coupling ring 622*a* under lip 630*c* will only pop out when the athlete is subjected to a predetermined force greater than the release threshold.

Cleat 618*a* is preferably made of a plastic material such as a high-impact resistent plastic resin such as polycarbonate or Teflon or Zytel. Cleat 618*a* has a lower surface 668*a* for contacting the ground, an upper surface 670*a* with a spherical recess 634*a* and a side surface 674*a* extending between lower surface 668*a* and upper surface 670*a*.

Coupling ring 622*a* includes a first insert member 623*a* and a second insert member 625*a* which are both preferably made of a hard, rigid plastic material such as nylon or Teflon. Of course, inserts 623*a* and 625*a* can be made of any rigid material such as metal. Insert 623*a* is substantially oblong shaped, and includes a lower spherical portion 642*a* to be received in spherical recess 634*a* of cleat 618*a*, and an upper spherical portion 644*a*.

Second insert member 625*a* includes an annular curved member 678*a* along its upper surface 670*a*, and a lower surface 671*a* with a spherical recess 673*a* for receiving upper spherical portion 644*a* of first insert member 623*a*. The tolerances between spherical recess 673*a* and upper spherical portion 644*a* can be such that they may rotate relative to one another or remain stationary, as desired.

Cleat Assembly 710 of FIG. 34–37

Referring now to FIGS. 34–37, a cleat assembly 710 in accordance with an eighth embodiment of the present invention is illustrated. Cleat assembly 710 is substantially identical to cleat assembly 510, discussed above, except that coupling member 722 is integrally formed with cleat 718. Thus, cleat assembly 710 will not be discussed or illustrated in detail herein.

Cleat 718 includes a lower surface 768 for contacting the ground, an upper surface 770 with an integral coupling ring 722 extending upwardly therefrom, and a conical side surface 744 extending between surfaces 768 and 770. Coupling ring 722 has a convexly curved outer side surface 746 with a diameter slightly larger than the diameter of circular recess 734 to retain cleat 718 therein via a snap-fit.

Support housing 720 is integrally formed with sole 716 and has a lower surface 726 with a circular recess 734 for receiving a portion of cleat 718 therein. Recess 734 has a flat bottom surface 736 and an annular, curved side surface 738.

Athletic Shoe 810 of FIGS. 38–41

Figure 38:
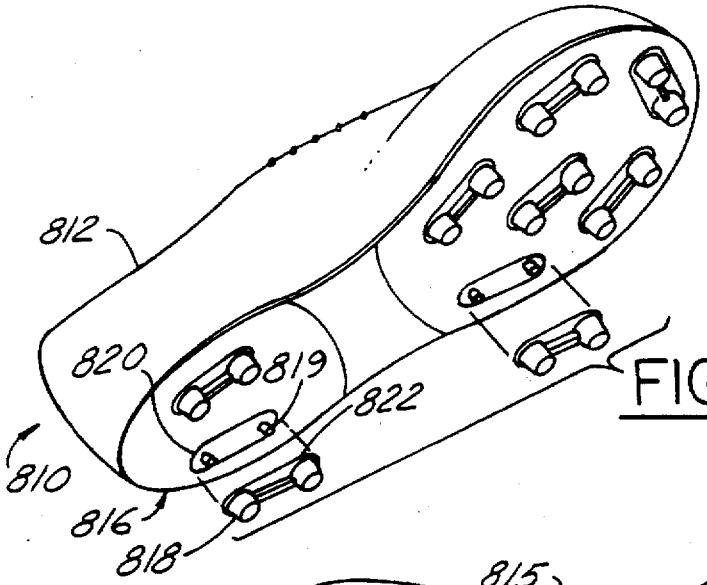
FIG. 38 shows a perspective view of an athletic shoe having releasable cleats fastened to the sole of the shoe body in accordance with a ninth embodiment of the present invention.

Referring now to FIG. 38, an athletic shoe 810 is illustrated and includes an upper shoe body 812, and a sole 816. Sole 816 includes a plurality of recessed areas or integrally molded support housings 820 with male connection elements or protrusions 819. Cleats 818 are fixedly attached to cleat bases 822 which may then be attached to recessed areas 820 of the sole portions 824 and 826.

Figure 39:
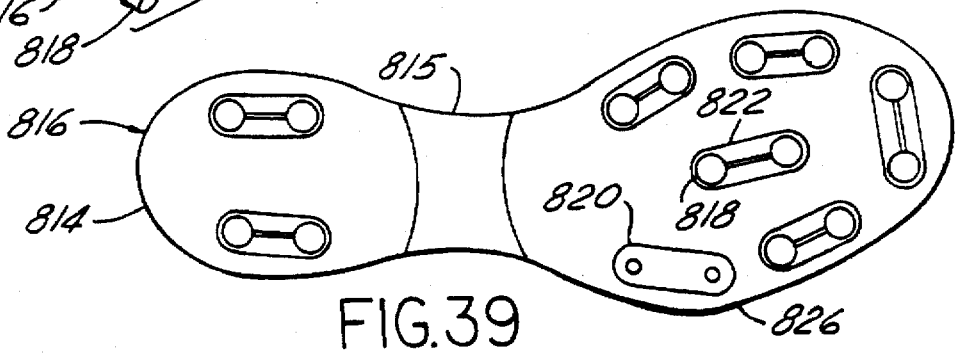
FIG. 39 illustrates a bottom plan view of the shoe of FIG. 38, illustrating the placement of the cleats.

A bottom plan view of sole 816, as shown in FIG. 39, shows the relative placement of the sole portions 824 and 826, as well as the cleats 818 with cleat bases 822. The central area 815 of sole 816 may be used to contain taping of the shoe which is common among athletes. As the tape may be placed over central area 815 of sole 816, it does not interfere with the break away action of the cleats and cleat bases 820 and 822, respectively.

Figure 40:
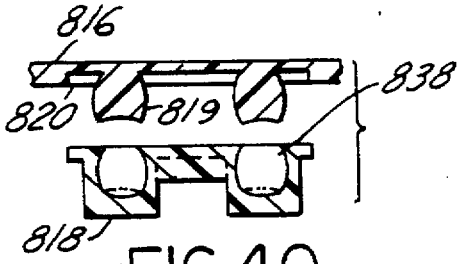
FIG. 40 is a cross-sectional view of one possible connection unit configuration showing interlocking parts.

In order to achieve the break away feature of the cleat embodiment of the present invention, FIG. 40 shows one configuration of a releasably connection unit or cleat assembly which is attached to at least portions of sole 816 and at least one complementary mating cleat base. The cleat base 822 has at least one cleat attached thereto, and also has a mating connection unit or recess 838 adapted for releasably engaging and coupling the cleat base to the connection element 819 attached to the sole of the upper shoe body.

In particular, FIG. 40 shows a recessed portion 820 with the male protrusion 819 integrally attached to the sole 816 of the shoe. The mating cleat 818 has a female indentation or recess 838 to mate with the male protrusion 819.

Figure 41:
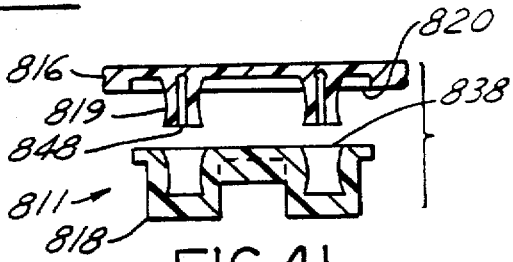
FIG. 41 is a cross-sectional view of yet another embodiment of the connection unit showing interlocking parts.

FIG. 41 shows a modified embodiment of a releasably engageably connection unit or cleat assembly 811 having cleats 818 releasably coupled to male protrusions 819 of support housing or recessed area 820 which is molded into sole 816. The male protrusions 819 have a voided area 848 which is designed to compress as the male protrusion 846 is squeezed into the recesses 838 of cleats 818. This embodiment is substantially identical to the embodiment of FIGS. 38–40, and thus will not be discussed or illustrated in detail.

Cleat Assembly 910 of FIGS. 42–45

Referring now to FIGS. 42–45, cleat assembly 910 in accordance with another embodiment of the present invention is illustrated, and includes break away sole portions 970 and 974 including fasteners 972. Fasteners 972 may be of many configurations, including, but not limited to the fastening configurations disclosed in FIGS. 42 and 43, as well as a hook and loop fastening means, such as velcro, a registered trademark of the Velcro Corporation, or Dual Lock, a trademark of the 3-M Industrial Specialties Division.

Figure 42:
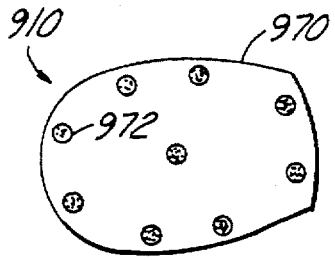
FIG. 42 shows a top plan view of a second sole portion to be attached to a first sole attached to the upper shoe body.
Figure 43:
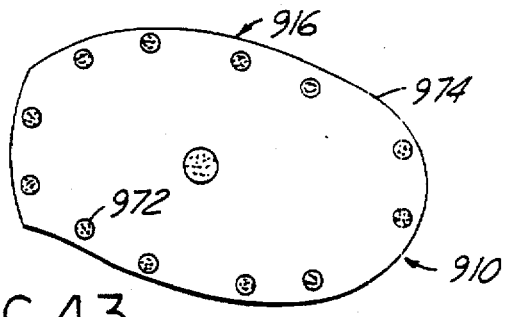
FIG. 43 shows a top plan view of a second sole portion to be attached to the front portion of the shoe.
Figure 44:
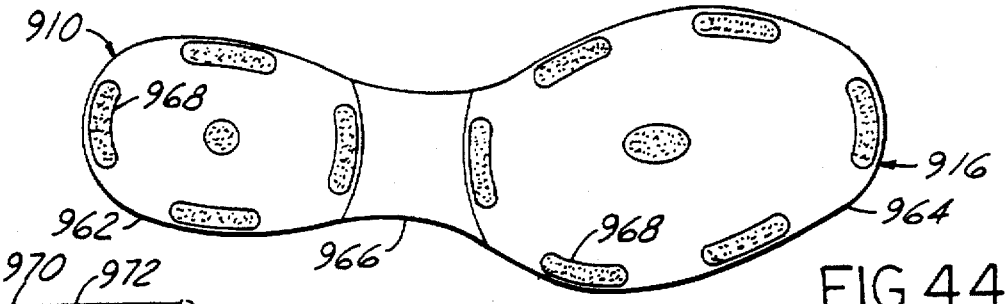
FIG. 44 is a bottom plan view of a first sole showing the placement of the fastening means.

FIG. 44 shows the placement of the engageable connection units or fasteners 968 rigidly coupled on sole 916 in heel region 962 and front region 964. The connection units or fasteners 968 are designed to mate with the connection unit or fasteners 972 shown in FIGS. 42 and 43. The amount of connection units or fasteners which are utilized in this embodiment may be tailored for specific weight and medical requirements for individual athletes in order to "program" the amount of lateral load force which can be applied before the second sole portions 970 and 974 break away from the first sole 916 which is attached to the upper shoe body. Second sole portions 970 and 974, shown in FIGS. 42 and 43, are separate pieces to enable the athlete to tape his shoe to his foot over the central area 966 of sole 916.

Figure 45:
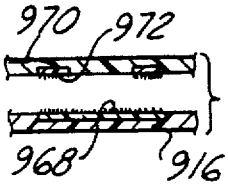
FIG. 45 is a partial, cross-sectional view of the second sole portion and sole prior to attachment.

FIG. 45 shows how the sole 916, including connection units 968, are coupled to second sole portion 970 with its complementary mating connection units 972. The frequency or number of the connection units 972 will determine the amount of shear strength which will be required to tear the second sole portions 970 and 974 from the first sole portion 916. For instance, if the connection units 968 of sole 916 were the same size as the connection unit 972 on second sole portions 970 and 974, a much greater shear strength would be required to break away the second sole portions 970 and 974 than it would if connection units 972 of the second sole portion were smaller in size in comparison to the connection units 968 of the sole 916.

Cleat Assembly **910*a* of FIGS. 46–49**

Figure 46:
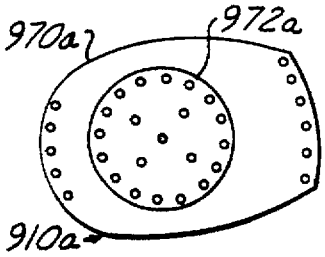
FIG. 46 is a top plan view of a second sole portion heel showing the relative placement of the connection units.
Figure 47:
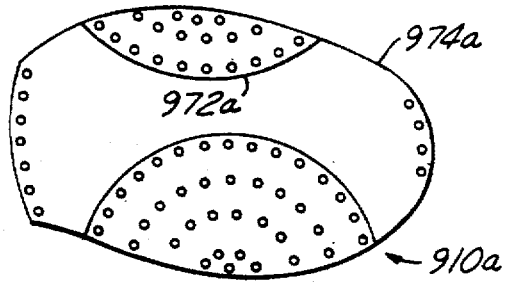
FIG. 47 is a top plan view of the second shoe portion to be attached to the front of the shoe.
Figure 48:
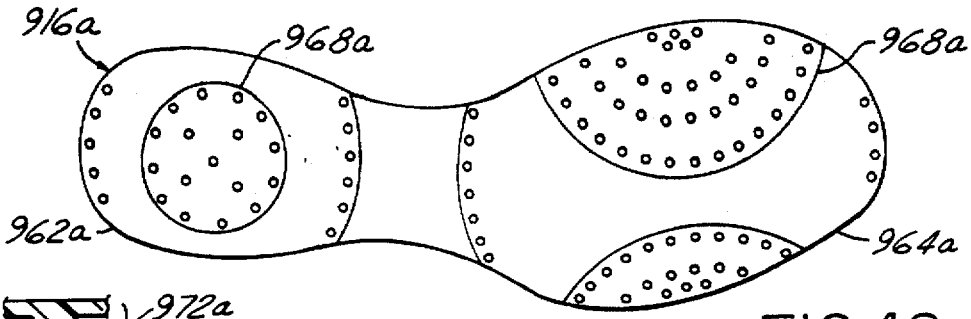
FIG. 48 is a bottom plan view of the upper body shoe having a sole attached thereto.
Figure 49:
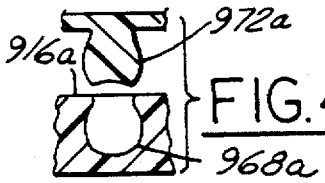
FIG. 49 is a cross-sectional side view of a connection unit used to fasten the second sole portions to the first sole.

Turning now to FIGS. 46–49, there is shown yet another embodiment of the present invention in which second sole portions **970*a* and 974*a*, as shown in FIGS. 46 and 47, may be attached to the first sole 916*a* as shown in FIG. 48 attached to the upper shoe body (not shown). FIG. 46 illustrates a second sole or heel portion 970*a*, which includes connection units 972*a* for mating with the complementary connection units 968*a* shown on heel portion 962*a* of the first sole 916*a*. Likewise, FIG. 47 shows a second sole portion 974*a* having connection units 972*a* which mates with complementary front portion 964*a* of the first sole 916*a*. Connection unit 968*a* of the first sole 916*a* will mate with complementary connection units 972*a* as shown in FIG. 49. In this embodiment, it is envisioned that it is possible for the connection interlock shown in FIG. 49 to be employed. The shoe sole 916*a* has a male protrusion or connection unit 968*a* which will mate and interlock into recessed area or connection unit 972*a* of the second sole portion 970*a***.

Figure 50:
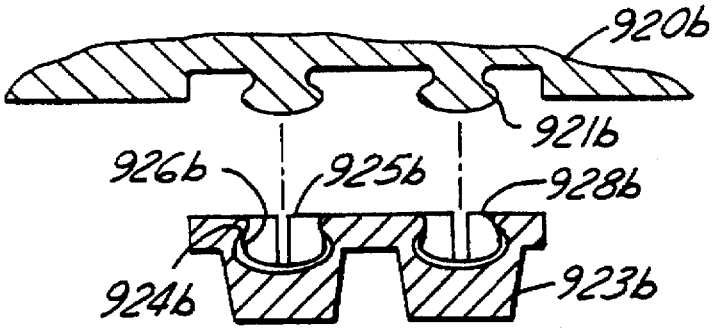
FIG. 50 is a cross-sectional view of another embodiment of the fastening connection unit.
Figure 51:
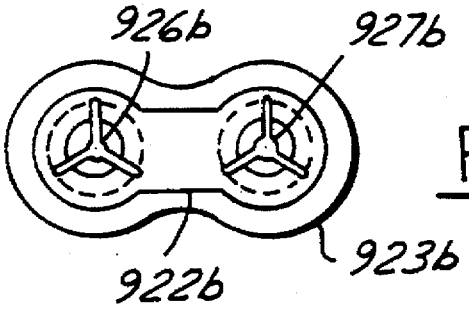
FIG. 51 is a top plan view of the fastener of FIG. 49.

Cleat Assembly **910*b* of FIGS. 50 and 51**

Referring now to FIG. 50, a separate embodiment of the connection unit is illustrated in which sole surface **920*b* of the first sole includes male protrusion 921*b* which is designed to be incorporated into recessed areas 928*b* of the cleats 923*b*. A separate spring 922*b* is attached to the cleat portion 923*b* in such a way as to form a void 924*b* such that when male protrusion 921*b* is forced into recessed area 928*b* the spring 922*b* can respond by flexing into the void 924*b***.

FIG. 51 shows a top plan view of the cleated connection unit of FIG. 50, in which the cleat **923*b* is shown with spring 922*b* in place. Spring 922*b* may include slits 925*b*, and may include either a removed portion 926*b*, or a solid portion 927*b*, depending upon the strength of the spring required. The low profile shape of the male protrusion 921*b*, in relationship to first sole 920*b*, will allow for a better surface for energy reduction once release has occurred. Release is achieved by the floating spring 922*b* that is molded separately from cleat 923*b*. The spring may be bonded to the cleat by sonic welding, or any other standard means of attachment. Free movement independent from the spring retention action when male protrusion 921*b* is inserted or released from recessed area 928*b* is accomplished by void slits 925*b***.

The releasable cleats in all of the above embodiments, for example, might release or break away before about 350 to 950 Newtons of force would be transferred to soft tissues in and around the knee or ankle. The soft tissues protected by the cleat assemblies in accordance with the present invention include the anterior cruciate, posterior cruciate, medial collateral and lateral collateral ligaments.

The connection between the cleat and the base assembly may include an interlocking pair of fasteners as shown in the attached drawings which may be made from a material selected from a group consisting of rubbers, plastics, thermoplastics, elastomers, elastomeric resins and urethanes.

Further, as discussed above, it may be preferably to include connection units or cleat assemblies which include male and female complementary physical connections that interlock to provide a connection such that the tensile strength is much greater than the shear or peel strength.

Therefore, a substantial lateral force upon the leg of the athlete wearing the athletic shoe with a cleat will cause the male and female interlock connection of the cleat assembly to release from the attached to the upper shoe body. This will substantially reduce soft tissue injury to the athlete wearing the shoe.

The release threshold of the cleat assemblies or connection units discussed above may be individually selected to accommodate the individual's weight, performance abilities, or certain medical requirements so that the cleats may be individually responsive and dependent upon the predetermined break away force to substantially reduce injuries to the athlete.

While the subject invention has been described in terms of several specific embodiments, it must be appreciated that other embodiments could readily be adapted by one skilled in the art. Accordingly, the scope of the subject invention is to be limited only by the following claims.

What is claimed is:

1. An athletic shoe for reducing injuries to an athlete wearing the shoe, comprising;

a shoe body having a longitudinal axis along the length thereof and a lateral axis substantially perpendicular to said longitudinal axis;

said shoe body having an outside portion and an inside portion along said lateral axis corresponding to the outside and inside, respectively of the leg of the wearer wearing the shoe;

a sole attached to said shoe body, said sole generally defining a plane;

a plurality of cleat members detachably connected to said sole;

said detachable cleat members being independently detachable from said sole only upon a single application of a force in a predetermined direction parallel to said plane of said sole; and selection means for permitting detachment of said detachable cleats only in a selected one of a plurality of directions parallel to said plane of said sole.

* * * * *